US008402945B2

(12) United States Patent
Fujino et al.

(10) Patent No.: US 8,402,945 B2
(45) Date of Patent: Mar. 26, 2013

(54) INJECTOR AND METHOD FOR MAKING THE SAME

(75) Inventors: Tomoki Fujino, Okazaki (JP); Jun Kondo, Nagoya (JP)

(73) Assignee: Denso Corporation, Kariya (JP)

( * ) Notice: Subject to any disclaimer, the term of this patent is extended or adjusted under 35 U.S.C. 154(b) by 411 days.

(21) Appl. No.: 12/753,280

(22) Filed: Apr. 2, 2010

(65) Prior Publication Data

US 2010/0251997 A1 Oct. 7, 2010

(30) Foreign Application Priority Data

Apr. 3, 2009 (JP) ..... 2009-90739

(51) Int. Cl.
*F02M 51/00* (2006.01)

(52) U.S. Cl. ..... 123/435; 123/494; 73/114.51

(58) Field of Classification Search ..... 123/488, 123/494, 435; 73/35.12, 114.18, 114.43, 73/114.45, 114.51
See application file for complete search history.

(56) References Cited

U.S. PATENT DOCUMENTS 4,035,204 A * 7/1977 Hack et al. ..... 148/210
7,918,128 B2 * 4/2011 Kondo et al. ..... 73/114.43
7,931,009 B2 * 4/2011 Kondo et al. ..... 123/490
8,224,554 B2 * 7/2012 Kondo et al. ..... 701/104
2008/0228374 A1 9/2008 Ishizuka et al.
2011/0277887 A1 * 11/2011 Foerster et al. ..... 148/235

FOREIGN PATENT DOCUMENTS

JP 2008-243807 10/2008
JP 2010-242579 * 10/2010

OTHER PUBLICATIONS

U.S. Appl. No. 12/753,256, filed Apr. 2, 2010.
U.S. Appl. No. 12/753,259, filed Apr. 2, 2010.
U.S. Appl. No. 12/753,274, filed Apr. 2, 2010.

* cited by examiner

*Primary Examiner* — Hai Huynh
(74) *Attorney, Agent, or Firm* — Nixon & Vanderhye P.C.

(57) ABSTRACT

An injector includes a nozzle hole, a metal body including a high pressure passage inside the body, and a fuel pressure sensor attached to the body to detect fuel pressure. The sensor includes a metal flexure element resiliently deformed upon application of fuel pressure to the flexure element, and a sensor element that converts flexure in the flexure element into an electrical signal and outputs the signal as a pressure detection value. The body includes a sensor high pressure passage communicating with the flexure element, and a body side sealing surface on which the flexure element is pressed and closely-attached so that a clearance between the body and the flexure element is metal-to-metal sealed on the sealing surface. Carburizing treatment is performed on at least a part of the body that defines the sensor high pressure passage. The carburizing treatment is not performed on the sealing surface.

6 Claims, 4 Drawing Sheets

INJECTOR AND METHOD FOR MAKING THE SAME

CROSS REFERENCE TO RELATED APPLICATION

This application is based on and incorporates herein by reference Japanese Patent Application No. 2009-90739 filed on Apr. 3, 2009.

BACKGROUND OF THE INVENTION

1. Field of the Invention

The present invention relates to an injector that is disposed in an internal combustion engine to inject fuel, which serves for combustion, through a nozzle hole.

2. Description of Related Art

In order to accurately control output torque and a state of emissions of an internal combustion engine, it is important to accurately control a state of fuel injection, such as injection start time and injection quantity of fuel injected from an injector. Accordingly, a technology for detecting an actual state of injection by detecting pressure of fuel that varies with the injection is conventionally proposed. For example, actual injection start time is detected by detecting the start time of decrease of fuel pressure in accordance with the injection start, and actual injection completion time is detected by detecting time for the stop of increase of fuel pressure in accordance with completion of the injection (see, for example, Japanese Unexamined Patent Application Publication No. 2008-144749 corresponding to US2008/0228374A1).

In detecting such a fluctuation of fuel pressure, the fluctuation of fuel pressure caused due to the injection is buffered in the common rail using a fuel pressure sensor (rail pressure sensor) that is disposed directly in a common rail (pressure accumulation container). Therefore, accurate fluctuation of fuel pressure cannot be detected. For this reason, the technology described in the Publication No. 2008-144749 aims to detect the fuel pressure fluctuation before the fuel pressure fluctuation due to the injection is buffered in a common rail, by disposing a fuel pressure sensor in an injector.

The above-described injector generically includes a body, a needle, and an actuator. The needle and actuator are accommodated in the body. The body has a high pressure passage, through which high pressure fuel flows into a nozzle hole, inside the body. The needle opens and closes the nozzle hole and the actuator drives the needle.

The present inventors have examined the attachment of a fuel pressure sensor configured in the following manner, to the above-described body. That is, the fuel pressure sensor is composed of a flexure element that is attached to the body and resiliently deformed upon application of fuel pressure to the element, and a sensor element that converts a value of flexure generated in the flexure element into an electrical signal and outputs the signal as a pressure detection value.

The present inventors have explored a metal-touch seal (metal-to-metal seal) by forming sealing surfaces on both the flexure element and the body and by pressing both the sealing surfaces against each other to closely-attach the surfaces so that high pressure fuel does not leak out of a joint surface between the body and the flexure element. Particularly, in a recent diesel engine, pressurization of fuel (e.g., about 200 MPa) is promoted. Thus, high-pressure fuel is easily and suitably sealed using the metal-touch seal as compared to a seal with a gasket between the body and the flexure element.

By closely-attaching the sealing surfaces to each other with the sealing surface of any one of the body and the flexure element plastically-deformed, sealing characteristics of the metal-touch seal are improved. However, the body needs to have higher hardness through carburizing treatment so as to hold out against stress concentration in the high pressure passage. Moreover, the flexure element needs to be formed to be thin-walled so that the element is resiliently deformed. Accordingly, a material having higher hardness needs to be selected to ensure strength that can resist high pressure fuel. In other words, both the body and the flexure element need to have higher hardness. Because of this, when the higher-hardness members are metal-touch sealed with each other, the above-described plastic deformation is insufficient and the sealing characteristics cannot be fully improved.

SUMMARY OF THE INVENTION

The present invention addresses at least one of the above disadvantages.

According to the present invention, there is provided an injector adapted to be disposed in an internal combustion engine for injecting fuel into the engine. The injector includes a nozzle hole, a metal body, and a fuel pressure sensor. Fuel is injected through the nozzle hole. The metal body includes a high pressure passage inside the body. High pressure fuel flows into the nozzle hole through the high pressure passage. The fuel pressure sensor is attached to the body and configured to detect pressure of high pressure fuel. The fuel pressure sensor includes a metal flexure element and a sensor element. The metal flexure element is resiliently deformed to produce a flexure upon application of the pressure of high pressure fuel to the flexure element. The sensor element is configured to convert the flexure produced in the flexure element into an electrical signal and to output the signal as a pressure detection value. The body further includes a sensor high pressure passage and a body side sealing surface. The sensor high pressure passage communicates with the flexure element. Carburizing treatment is performed on at least a part of the body that defines the sensor high pressure passage. The flexure element is pressed and closely-attached on the body side sealing surface so that a clearance between the body and the flexure element is metal-to-metal sealed on the body side sealing surface. The carburizing treatment is not performed on the body side sealing surface of the body.

According to the present invention, there is also provided a method for making an injector for injecting fuel. The injector includes a nozzle hole, a metal body, and a fuel pressure sensor. Fuel is injected through the nozzle hole. The metal body includes a high pressure passage inside the body. High pressure fuel flows into the nozzle hole through the high pressure passage. The fuel pressure sensor is attached to the body and configured to detect pressure of high pressure fuel. The fuel pressure sensor includes a metal flexure element and a sensor element. The metal flexure element is resiliently deformed to produce a flexure upon application of the pressure of high pressure fuel to the flexure element. The sensor element is configured to convert the flexure produced in the flexure element into an electrical signal and to output the signal as a pressure detection value. The body further includes a body side sealing surface on which a clearance between the body and the flexure element is metal-to-metal sealed. According to the method, a sealing surface formation process is performed. In the sealing surface formation process, a body side sealing surface on the body is formed. Furthermore, a masking process is performed. In the masking process, a part of the body, which includes the body side sealing surface, is masked. Moreover, a surface hardening process is performed. In the surface hardening process, the body is carburized with the part of the body being masked. In addition, a sensor attachment process is performed. In the sensor attachment process, the fuel pressure sensor is attached to the body such that the flexure element is pressed and closely-attached on the body side sealing surface of the body.

According to the present invention, there is further provided a method for making an injector for injecting fuel. The injector includes a nozzle hole, a metal body, and a fuel pressure sensor. Fuel is injected through the nozzle hole. The metal body includes a high pressure passage inside the body. High pressure fuel flows into the nozzle hole through the high pressure passage. The fuel pressure sensor is attached to the body and configured to detect pressure of high pressure fuel. The fuel pressure sensor includes a metal flexure element and a sensor element. The metal flexure element is resiliently deformed to produce a flexure upon application of the pressure of high pressure fuel to the flexure element. The sensor element is configured to convert the flexure produced in the flexure element into an electrical signal and to output the signal as a pressure detection value. The body further includes a body side sealing surface on which a clearance between the body and the flexure element is metal-to-metal sealed. According to the method, a surface hardening process is performed. In the surface hardening process, the body is carburized before formation of the body side sealing surface on the body. Furthermore, a removal process is performed. In the removal process, a surface hardening layer, which is formed as a result of the carburizing of the body, is removed from the body. Moreover, a sealing surface formation process is performed. In the sealing surface formation process, the body side sealing surface is formed in a part of the body from which the surface hardening layer is removed. In addition, a sensor attachment process is performed. In the sensor attachment process, the fuel pressure sensor is attached to the body such that the flexure element is pressed and closely-attached on the body side sealing surface of the body.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
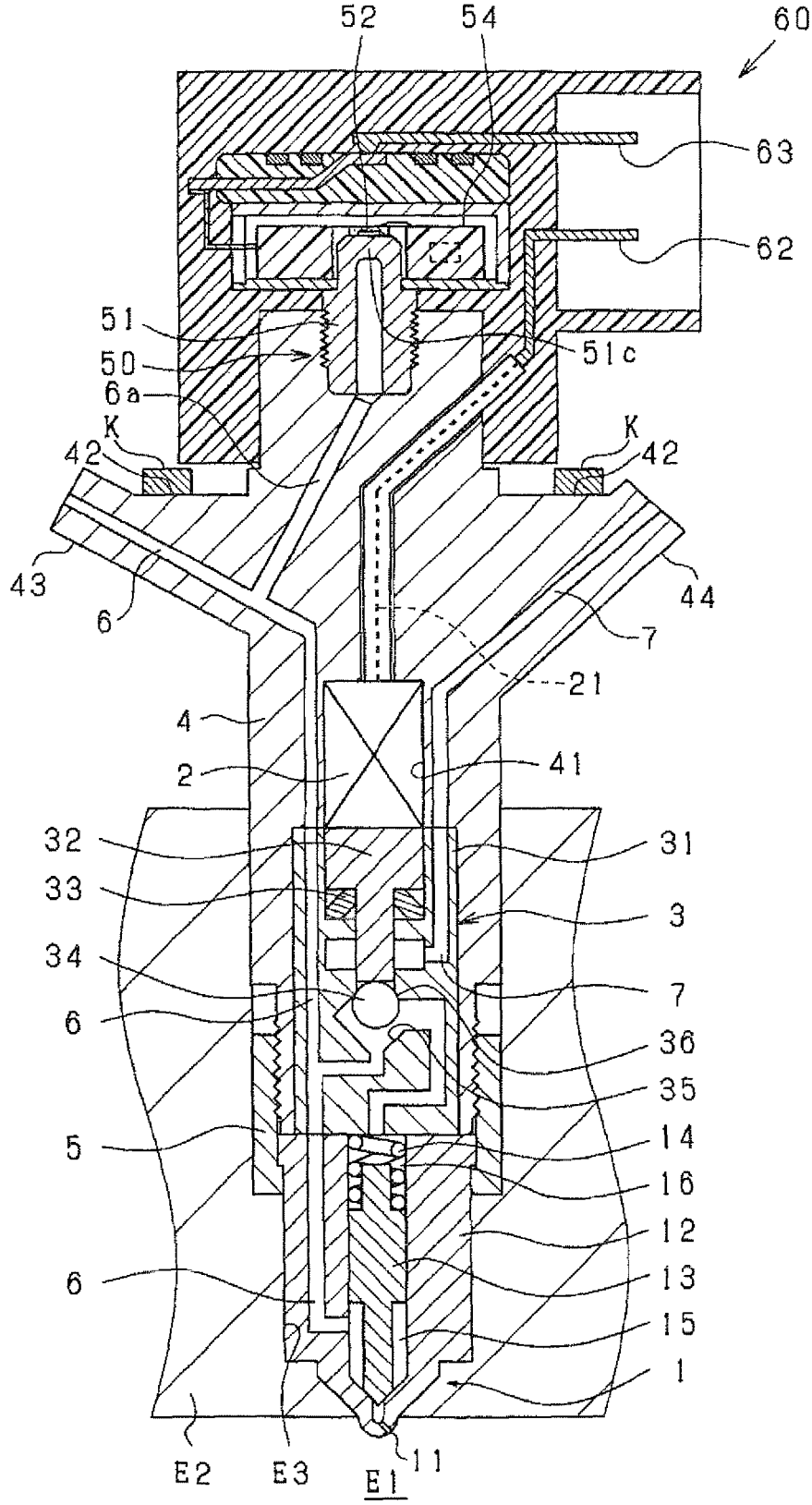
FIG. 1 is a sectional view generally illustrating an inner structure of an injector in accordance with a first embodiment of the invention.

Embodiments of the invention will be described below with reference to the accompanying drawings. The same numerals are used in the drawings to indicate the same or equivalent parts in the following embodiments, and the preceding description of the component having the same numeral is referred to when explaining the parts with the same numerals.

First Embodiment

A first embodiment of the invention will be described below with reference to FIGS. 1 to 4. Firstly, basic structure and operation of an injector of the first embodiment will be described based on FIG. 1.

The injector injects high pressure fuel stored in a common rail (pressure accumulation container: not shown) into a combustion chamber E1, which is formed in a cylinder of a diesel internal combustion engine. The injector includes a nozzle 1 through which fuel is injected when it is opened, an electric actuator 2 (driving means) that is driven upon supply of electric power to the actuator 2, and a back pressure control mechanism 3 that is driven by the electric actuator 2 to control a back pressure of the nozzle 1.

The nozzle 1 includes a nozzle body 12 having a nozzle hole 11, a needle 13 that engages with and disengages from a valve seat of the nozzle body 12 so as to close and open the nozzle hole 11, and a spring 14 that urges the needle 13 in a valve closing direction.

A piezoelectric actuator, which includes a layered product (piezoelectric stack) obtained by stacking many piezoelectric elements, is applied to the electric actuator 2. By switching between charge and discharge of the piezoelectric elements, the electric actuator 2 is switched between its expanded state and contracted state. Accordingly, the piezoelectric stack functions as an actuator that actuates the needle 13. Alternatively, an electromagnetic actuator including a stator and an armature may be adopted instead of the piezoelectric actuator.

A piston 32 that moves in accordance with the extension and contraction of the piezoelectric actuator 2, a disc spring 33 that urges the piston 32 toward the piezoelectric actuator 2, and a valving element 34 having a spherical shape that is driven by the piston 32 are accommodated in a valve body 31 of the back pressure control mechanism 3.

An injector body 4 having a generally cylindrical shape includes a stepped cylindrical accommodation hole 41, which extends in an axial direction of the injector (upper and lower directions in FIG. 1), at a central portion in a radial direction of the injector body 4. The piezoelectric actuator 2 and the back pressure control mechanism 3 are accommodated in the accommodation hole 41. By screwing a retainer 5 having a generally cylindrical shape on the injector body 4, the nozzle 1 is held at an end portion of the injector body 4.

The nozzle body 12, the injector body 4, and the valve body 31 include a high pressure passage 6 to which high pressure fuel is constantly supplied from the common rail, and a low pressure passage 7 which is connected to a fuel tank (not shown). These bodies 12, 4, 31 are made of metal, and are made to have high strength after quenching treatment. In addition, surfaces of the bodies 12, 4, 31 are made to have higher hardness through carburizing treatment.

These bodies 12, 4, 31 are inserted and disposed in an insertion hole E3, which is formed in a cylinder head E2 of the engine. An engagement part 42, which engages with one end portion of a clamp K, is formed on the injector body 4. By fastening the other end portion of the clamp K to the cylinder head E2 with a bolt, the one end portion of the clamp K presses the engagement part 42 toward the insertion hole E3. Accordingly, the injector is fixed, being pressed against the inside of the insertion hole E3.

A high pressure chamber 15, which serves as a part of the high pressure passage 6, is formed between an outer peripheral surface of the needle 13 on the nozzle hole 11-side and an inner peripheral surface of the nozzle body 12. The high pressure chamber 15 communicates with the nozzle hole 11 when the needle 13 is displaced in a valve opening direction. A backpressure chamber 16 is formed on an opposite side of the needle 13 from the nozzle hole 11. The above-described spring 14 is disposed in the backpressure chamber 16.

A high pressure seat surface 35 is formed on the valve body 31 in a route that communicates between the high pressure passage 6 in the valve body 31 and the backpressure chamber 16 of the nozzle 1, and a low pressure seat surface 36 is formed on the valve body 31 in a route that communicates between the low pressure passage 7 in the valve body 31 and the backpressure chamber 16 of the nozzle 1. The above-described valving element 34 is disposed between the high pressure seat surface 35 and the low pressure seat surfaces 36.

A high pressure port 43 (high pressure pipe connection) connected to a high pressure pipe (not shown) and a low pressure port 44 (low pressure pipe connection) connected to a low pressure pipe (not shown) are formed in the injector body 4. Fuel, which is fed into the high pressure port 43 from the common rail through the high pressure pipe, is supplied from an outer peripheral surface-side of the cylindrical injector body 4. The fuel which is supplied to the injector flows into the high pressure chamber 15 and the backpressure chamber 16 via the high pressure passage 6.

The high pressure passage 6 includes a branch passage 6*a* that branches toward a portion of the injector body 4 on the opposite side from the nozzle hole 11. Fuel in the high pressure passage 6 is led by the branch passage 6*a* into a fuel pressure sensor 50, which is described in greater detail hereinafter.

A connector 60 is attached to an upper portion of the injector body 4 on the opposite side from the nozzle hole 11. The electric power supplied to a terminal (drive connector terminal 62) of the connector 60 from the outside, is fed into the piezoelectric actuator 2 via a lead wire 21, and accordingly, the piezoelectric actuator 2 extends. The actuator 2 contracts upon stop of the electric power supply.

In a state where the piezoelectric actuator 2 is contracted given the above-described structure, as shown in FIG. 1, the valving element 34 is in contact with the low pressure seat surface 36, so that the backpressure chamber 16 communicates with the high pressure passage 6. Accordingly, high-pressure fuel is introduced into the backpressure chamber 16. The needle 13 is urged in the valve closing direction by the fuel pressure in the backpressure chamber 16 and the spring 14 so as to close the nozzle hole 11.

In a state where the piezoelectric actuator 2 is extended upon application of voltage to the piezoelectric actuator 2, on the other hand, the valving element 34 is in contact with the high pressure seat surface 35, so that the backpressure chamber 16 is connected to the low pressure passage 7. Accordingly, the pressure in the backpressure chamber 16 decreases. Then, the needle 13 is urged in the valve opening direction by fuel pressure in the high pressure chamber 15 so as to open the nozzle hole 11. As a result, fuel is injected into the combustion chamber E1 through the nozzle hole 11.

In accordance with the fuel injection through the nozzle hole 11, the pressure of high pressure fuel in the high pressure passage 6 fluctuates. The fuel pressure sensor 50 for detecting this pressure fluctuation is attached to the injector body 4. By detecting the time that the fuel pressure starts to decrease in accordance with the start of the injection through the nozzle hole 11 in a waveform of the pressure fluctuation detected by the fuel pressure sensor 50, actual injection start time is detected. By detecting the time that the fuel pressure starts to increase in accordance with injection completion, actual injection completion time is detected. Furthermore, the injection quantity is detectable by detecting a maximal value of the amount of the fuel pressure decrease caused in accordance with the injection in addition to the injection start time and the injection completion time.

Figure 2:
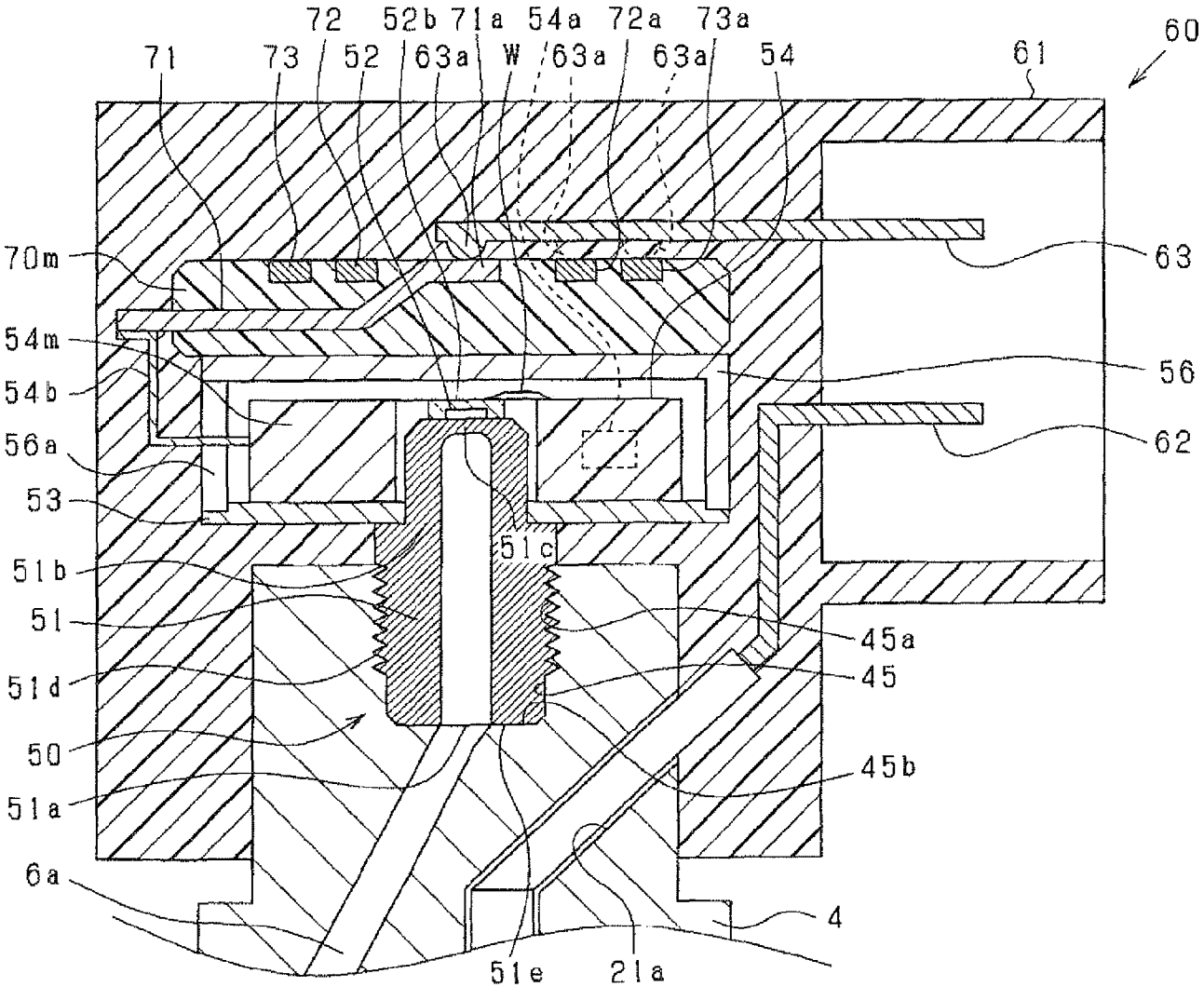
FIG. 2 is an enlarged view of FIG. 1 illustrating a structure for attachment of a fuel pressure sensor to the injector.

Next, structure of a single body of the fuel pressure sensor 50 and structure of the fuel pressure sensor 50 for its attachment to the injector body 4 will be described below with reference to FIG. 2.

The fuel pressure sensor 50 includes a stem 51 (flexure element) that is resiliently deformed upon application of pressure of high pressure fuel in the branch passage 6*a* to the stem 51, and a strain gage (sensor element) 52 that converts a value of flexure produced in the stem 51 into an electrical signal to output the signal as a pressure detection value.

The stem 51 includes a cylindrical portion (circumferential portion) 51*b* having a cylindrical shape, and a diaphragm portion 51*c* having a disc shape. An inflow port 51*a*, through which high pressure fuel is conducted into the stem 51, is formed at one end portion of the cylindrical portion 51*b*, and the diaphragm portion 51*c* covers the other end portion of the cylindrical portion 51*b*. The pressure of high pressure fuel, which flows into the cylindrical portion 51*b* through the inflow port 51*a*, is applied to an inner peripheral surface of the cylindrical portion 51*b* and the diaphragm portion 51*c*, and thereby the entire stem 51 is resiliently deformed.

The stem 51 is made of metal, and high strength and high hardness because of the application of very high pressure to the stem 51, and small deformation by thermal expansion of the stem 51, which results in little influence upon the strain gage 52 (i.e., small coefficient of thermal expansion), are required for the metallic material of the stem 51. More specifically, materials, which mainly contain iron (Fe), nickel (Ni), and cobalt (Co), or Fe and Ni, and to which titanium (Ti), niobium (Nb), and aluminum (Al), or Ti and Nb serving as precipitation strengthening materials are added, may be selected for the stem 51. The stem 51 may be formed from these materials by for example, press work, cutting work, or cold forging operation. Alternatively, materials, to which carbon (C), silicon (Si), manganese (Mn), phosphorus (P), or sulfur (S), for example, is added, may be selected.

A recess 45, in which the cylindrical portion 51*b* of the stem 51 is inserted, is formed on an end face of the cylindrical injector body 4 on the opposite side from the nozzle hole 11. An internal thread portion 45*a* (body side screw portion) is formed on an inner peripheral surface of the recess 45, and an external thread portion 51*d* (sensor side screw portion) is formed on an outer peripheral surface of the cylindrical portion 51*b*. By screwing the external thread portion 51*d* of the stem 51 to the internal thread portion 45*a* of the injector body 4, the fuel pressure sensor 50 is attached to the injector body 4.

A sensor side sealing surface 51*e* is formed on an end face of the cylindrical portion 51*b* located around the inflow port 51*a*, and a body side sealing surface 45*b* is formed on a bottom face of the recess 45. Both the sealing surfaces 51*e*, 45*b* are surfaces expanding perpendicular to an axial direction of the stem 51 (upper and lower directions in FIG. 2), and have shapes expanding annularly around the inflow port 51*a*.

By closely-attaching the sensor side sealing surface 51*e* on the body side sealing surface 45*b* with the surface 51*e* pressed on the surface 45*b*, a clearance between the injector body 4 and the stem 51 is metal-touch sealed. The force (axial force) pressing both the sealing surfaces 51*e*, 45*b* is generated by screwing the stem 51 to the injector body 4. In other words, the attachment of the stem 51 to the injector body 4 and the generation of axial force are simultaneously carried out.

The strain gage 52 is attached to the diaphragm portion 51*c*. More specifically, the strain gage 52 is fixed by sealing (printing) the strain gage 52 with a glass member 52*b*, with the strain gage 52 being disposed on the diaphragm portion 51*c*. Accordingly, the strain gage 52 detects the magnitude (resilient deformation amount) of flexure produced in the diaphragm portion 51*c* when the stem 51 is resiliently deformed to be enlarged by the pressure of high pressure fuel which flows into the cylindrical portion 51*b*.

A metal plate 53 having a disc shape is attached to the stem 51, and a mold integrated circuit (IC) 54 (described in greater detail hereinafter) is fixed and supported on the plate 53.

The mold IC 54 is electrically connected to the strain gage 52 via a wire bond W, and configured by sealing an electronic component 54*a* and a sensor terminal 54*b* with a mold resin 54*m*. The electronic component 54*a* includes an amplifying circuit for amplifying a detection signal outputted from the strain gage 52, a filtering circuit for removing noise that overlaps with the detection signal, and a circuit for applying a voltage to the strain gage 52, for example.

In addition, the strain gage 52, to which the voltage is applied by the voltage applying circuit, constitutes a bridge circuit whose resistance value varies in accordance with the magnitude of flexure produced in the diaphragm portion 51*c*. As a consequence, output voltage of the bridge circuit varies according to the flexure of the diaphragm portion 51*c*, and the output voltage is outputted to the amplifying circuit of the mold IC 54 as the detection value of pressure of high pressure fuel. The amplifying circuit amplifies the pressure detection value that is outputted from the strain gage 52 (bridge circuit) to output the amplified signal from the sensor terminal 54*b*.

The mold resin 54*m* is formed in a cylindrical shape extending annularly along an outer peripheral surface of the cylindrical portion 51*b* of the stem 51. The sensor terminals 54*b* extend from an outer peripheral surface of the mold resin 54*m*. These sensor terminals 54*b* are electrically connected to the electronic component 54*a* in the mold IC 54 to function as, for example, a terminal for outputting the detection signal of the fuel pressure sensor 50, a terminal for supplying a power source, and a grounded terminal.

A case 56 is attached to an outer circumferential end portion of the plate 53. A portion of the cylindrical portion 51*b* of the stem 51 except the external thread portion 51*d*, the strain gage 52, and the mold IC 54 are accommodated inside the case 56 and the plate 53. Accordingly, the metal case 56 and the plate 53 block external noise so as to protect the strain gage 52 and the mold IC 54. Additionally, an opening 56*a* is farmed on an outer peripheral surface of the case 56, so that the sensor terminal 54*b* extends out from the inside to outside of the case 56 through the opening 56*a*.

A sensor connector terminal 63 is, along with the drive connector terminal 62, held by a housing 61 of the above-described connector 60. The sensor connector terminal 63 and the sensor terminal 54*b* are electrically connected via electrodes 71, 72, 73 (described in greater detail hereinafter) by laser welding, for example. A connector of an external harness that is connected to an external device (not shown) such as an engine electronic control unit (ECU) is connected to the connector 60. Accordingly, the pressure detection signal outputted from the mold IC 54 is inputted into the engine ECU via the external harness.

When rotating the stem 51 so as to screw the stem 51 to the injector body 4, a rotational position of the stem 51 is not determined to be a particular position at the time this screwing is completed. This means that a rotational position of the sensor terminal 54*b* of the mold IC 54 at the screwing completion time for the stem 51 is also unspecified.

Accordingly, annular connections 72*a*, 73*a* having shapes which extend annularly around a rotation center of the stem 51, are provided respectively for the electrodes 72, 73, which are connected to the corresponding sensor terminals 54*b* and rotated together with the stem 51. The annular connections 72*a*, 73*a* are electrically connected respectively to the connector terminals 63 after the screwing of the stem 51 is completed. As a result, the sensor terminal 54*b*, whose rotational position is unspecified, and the connector terminal 63, which is disposed at a predetermined position of the injector body 4, are easily electrically connected.

In addition, a connection 71*a* of the electrode 71 that is electrically connected to the connector terminal 63 is located at the rotation center of the stem 51. Therefore, a rotational position of the connection 71*a* is specified regardless of the rotational position of the stem 51. The electrodes 71 to 73 are molded in a mold resin 70*m* to be integrated. In such a molded state, the electrodes 71 to 73 are disposed on the case 56. A welded part 63*a* extending toward the connections 71*a*, 72*a*, 73*a* is formed on the connector terminal 63, and the laser energy when performing the laser welding is concentrated at the welded part 63*a*.

Next, procedures for the attachment of the fuel pressure sensor 50 and the like to the injector body 4, and a method for making the injector body 4, will be described below with reference to FIG. 3.

Figure 3:
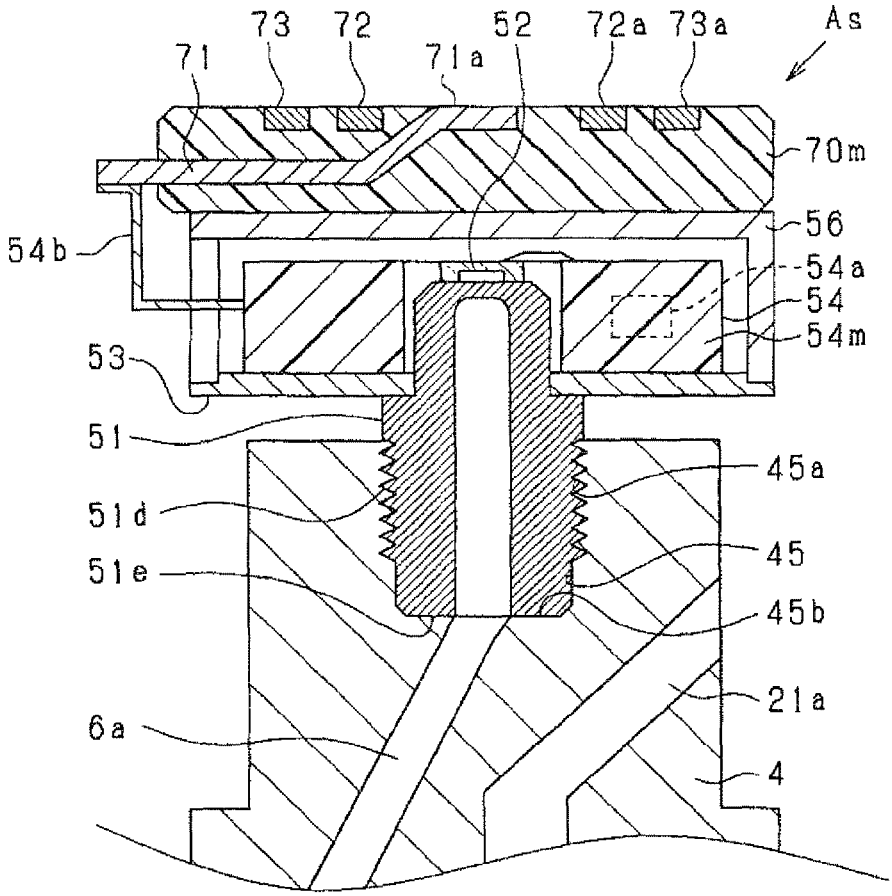
FIG. 3 is a diagram illustrating a state of attachment of a sensor assembly to an injector body in accordance with the first embodiment.

First, a sensor assembly As illustrated in FIG. 3 is assembled. More specifically, the plate 53 is attached to the stem 51, on which the strain gage 52 is attached, and then the mold IC 54 is fixed on the plate 53. After that, the mold IC 54 and the strain gage 52 are connected by the wire bond W using a bonding machine. Subsequently, the case 56 is attached to the plate 53. Furthermore, the electrodes 71 to 73 are molded in the mold resin 70*m*, and this mold compact is disposed at a predetermined position on the case 56. Afterwards, the electrodes 71 to 73 and the sensor terminal 54*b* are electrically connected by laser welding, for example. By the above-described procedures, the assembly of the sensor assembly As is completed.

After the sensor assembly As has been assembled, the sensor assembly As is attached to the injector body 4. More specifically, the external thread portion 51*d* of the stem 51 is fastened to the internal thread portion 45*a*, which is formed on the recess 45 of the injector body 4. Next, the drive connector terminal 62 and the lead wire 21 are electrically connected, and the sensor connector terminal 63 and the electrodes 71 to 73 are electrically connected by laser welding, for example.

After that, the connector terminals 62, 63 and the sensor assembly As are molded in mold resin with them being attached to the injector body 4. This mold resin is formed into the above-described housing 61 of the connector 60. By the above-described procedures, the attachment of the fuel pressure sensor 50 and the like to the injector body 4 and the internal electric connection are completed.

Figure 4:
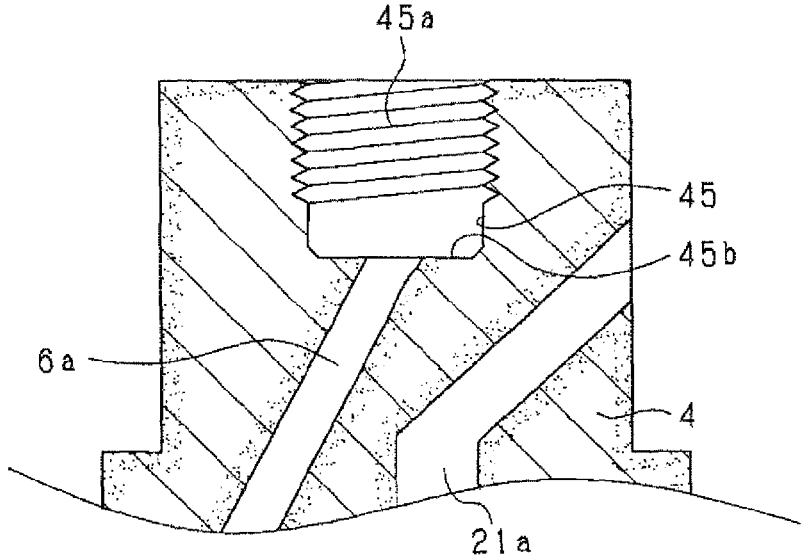
FIG. 4 is a diagram illustrating a range of the injector body that is hardened by carburizing treatment in accordance with the first embodiment.

The method for making the injector body 4, which is a main feature of the present embodiment, will be described below with reference to FIG. 4.

First, by drilling the injector body 4, the high pressure passage 6, the low pressure passage 7, the accommodation hole 41, the branch passage 6*a*, the recess 45, a through hole 21*a* through which the lead wire 21 passes, and the like, are formed. Then, the internal thread portion 45*a* is formed on an inner peripheral surface of the recess 45 using a cutting tool.

Moreover, by grinding the bottom face of the recess 45, the body side sealing surface 45*b* is formed (sealing surface formation process).

After that, before carburizing and quenching treatment of the injector body 4, the body side sealing surface 45*b* and the internal thread portion 45*a* of the injector body 4 are masked for anti-carburization so as not to be made to have high hardness by the carburizing (masking process). More specifically, a paste agent for preventing entry of carbon into the injector body 4 is applied to the body side sealing surface 45*b* and the internal thread portion 45*a*. Alternatively, by screwing a cap member (not shown), which is provided separately from the stem 51, to the internal thread portion 45*a*, the recess 45 is closed by the cap member.

Following this, the injector body 4, which is masked, is put into a furnace for heat treatment to perform the carburizing and quenching treatment on the injector body 4 (surface hardening process). Accordingly, a region of the surface of the injector body 4 that is not masked (i.e., region indicated by halftone dots in FIG. 4) is subjected to the carburizing treatment so as to have high hardness. On the other hand, the carburizing treatment is not performed on the body side sealing surface 45*b* and the internal thread portion 45*a* (i.e., they are anti-carburized). Therefore, the surface 45*b* and the thread portion 45*a* do not have high hardness. Additionally, the process of putting the injector body 4 into the furnace for heating and performing the quenching treatment, and the process of putting the injector body 4 into a furnace for carburizing and performing the carburizing treatment may be separately carried out. Alternatively, the injector body 4 may be put into a furnace for simultaneously performing the heating and carburizing, and the quenching treatment and carburizing treatment may be simultaneously performed.

Subsequently, by screwing the stem 51, which constitutes the sensor assembly As, to the injector body 4 produced in the above-described manner, the sensor side sealing surface 51*e* is pressed against the body side sealing surface 45*b*, so that they are metal-touch sealed (sensor attachment process).

According to the present embodiment explained in full detail above, the following advantageous effects are produced.

Firstly, when making the injector body 4 have high hardness through the carburizing treatment, the body side sealing surface 45*b* is anti-carburized. Accordingly, plastic deformation of the body side sealing surface 45*b* when the sensor side sealing surface 51*e* is pressed on the body side sealing surface 45*b* for the metal-touch sealing, is reliably promoted. Thus, strength of the injector body 4 and the stem 51 as members that are capable of holding out against the high pressure fuel are ensured, and adhesion properties between both the sealing surfaces 45*b*, 51*e*, which metal-touch seal the clearance between both the members 4, 51, are improved. As a result, the injector body 4 is made to have high hardness, and sealing characteristics of the body 4 are improved. As a result, the strength of both the members 4, 51 is ensured, and at the same time their sealing characteristics are improved.

In addition, when improving the sealing characteristics of the members 4, 51 by increasing the pressing force (axial force) of the stem 51 that is applied to the body side sealing surface 45*b* through increasing the screwing force, or by increasing forming accuracy of both the sealing surfaces 45*b*, 51*e*, their processing cost may be increased. According to the present embodiment, the sealing characteristics of the metal-touch sealing are improved without the increase of axial force or the improvement of forming accuracy.

It is known that a portion of a metal member, on which the carburizing treatment has been performed, becomes brittle as a result of the concentration of hydrogen into a structure in the metal member. When such embrittlement is generated in a thread portion, since the thread portion has a shape that is subject to stress concentration, there is fear that fracture (delayed fracture) is caused despite the thread portion being within the elastic limit and under conditions of static load stress.

Secondly, when making the injector body 4 have high hardness through the carburizing treatment, the internal thread portion 45*a* is also anti-carburized. Accordingly, a possibility of delayed fracture at the internal thread portion 45*a* is lessened. By masking the entire recess 45, masking operation on the body side sealing surface 45*b* and masking operation on the internal thread portion 45*a* are carried out at the same time. Hence, working efficiency of masking operation is improved in comparison to separate masking operations.

Thirdly, a need to select a material having high hardness for the stern 51 having the thin-walled diaphragm portion 51*c* is high in order that the diaphragm portion 51*c* can hold out against high pressure fuel. For this reason, when metal-touch sealing the members 4, 51, the stem 51 cannot be sufficiently plastically-deformed. As a consequence, when the injector body 4 is anti-carburized in the above-described manner provided that such a stem 51 is employed, the above-described effect of improving the sealing characteristics without high precision in forming the sealing surfaces or the increase of axial force, is suitably produced.

Fourthly, the sensor side sealing surface 51*e* is formed on a cylindrical end portion of the stem 51 located around the inflow port 51*a*. In other words, the cylindrical end portion, which is formed into the inflow port 51*a*, is used as the sensor side sealing surface 51*e*, so that the stem 51 is downsized.

Fifthly, the external thread portion 51*d* is formed on the outer peripheral surface of the cylindrical portion 51*b* of the stem 51. In other words, the cylindrical portion 51*b* for leading the high pressure fuel from the inflow port 51*a* to the diaphragm portion 51*c* is used as a portion that is formed into the external thread portion 51*d*, so that the stem 51 is downsized.

Sixthly, the branch passage 6*a* that branches from the high pressure passage 6 is formed in the injector body 4, and the injector body 4 is configured such that the high pressure fuel in the branch passage 6*a* flows into the inflow port 51*a* of the stem 51. In the injector body 4 having the branch passage 6*a* in this manner, stress is easily concentrated in the branching portion. In consequence, a need to make the injector body 4 have high hardness is high in order that the branching portion can hold out against the high pressure fuel. By anti-carburizing the injector body 4 in the above-described manner provided that such an injector body 4 is employed, the above-described effect of improving the sealing characteristics without high precision in forming the sealing surfaces or the increase of axial force, is suitably produced.

Seventhly, because the stem 51 is provided separately from the injector body 4, the propagation loss when internal stress of the injector body 4 generated due to thermal expansion and contraction is propagated to the stem 51, is increased. In other words, by providing the stem 51 independently from the injector body 4, influence of flexure of the injector body 4 upon the stem 51 is reduced. Thus, according to the present embodiment, in which the strain gage 52 (sensor element) is attached to the stem 51, which is provided separately from the injector body 4, the influence of flexure of the injector body 4 on the strain gage 52 is limited as compared to direct attachment of the strain gage 52 to the injector body 4. Consequently, with the reduction of accuracy in detecting the fuel pressure by the sensor 50 being avoided, the fuel pressure sensor 50 is attached to the injector.

Eighthly, a material having a smaller coefficient of thermal expansion than the injector body 4 is applied to the material of the stem 51. Accordingly, generation of flexure as a result of the thermal expansion and contraction of the stem 51 itself is limited. Furthermore, only the stem 51 needs to be formed from a material having a small coefficient of thermal expansion in comparison to forming the entire injector body 4 from a material having a small coefficient of thermal expansion, so that their material costs are reduced.

Ninthly, the drive connector terminal 62 and the sensor connector terminal 63 are held by the same connector housing 61, and both the terminals 62, 63 are thereby arranged in the common connector 60. Because of that, the fuel pressure sensor 50 is attached to the injector without increasing the number of connectors, and the harness for connecting the external device such as the engine ECU, and the connector, extends in a bundle from the one connector 60 provided for the injector body 4. Therefore, management of the harness is simplified. Moreover, increase of labor hours for the connector connecting operation is avoided.

Tenthly, and finally, the stem 51, the strain gage 52, and the mold IC 54 are assembled into the sensor assembly As, and the attachment of the sensor assembly As to the injector body 4 is carried out by attaching the stem 51 to the injector body 4. Accordingly, an operation check of the strain gage 52 and the mold IC 54 is performed on the sensor assembly As alone, before the attachment of the sensor assembly As to the injector body 4. Therefore, in this stage of the operation check, it is determined whether abnormality is caused in the strain gage 52 or the mold IC 54. Then, those determined to be normal are attached to the injector body 4. In consequence, reduction in the yields of the injector due to the abnormality of the strain gage 52 or the mold IC 54 is limited before the assembly of the injector is completed.

Second Embodiment

In the above-described first embodiment, by masking the body side sealing surface 45*b* and the internal thread portion 45*a* before performing the carburizing and quenching treatment on the injector body 4, the sealing surface 45*b* and the thread portion 45*a* are anti-carburized. In a second embodiment of the invention, the carburizing and quenching treatment is performed on an injector body 4 before a body side sealing surface 45*b* and an internal thread portion 45*a* are formed on a recess 45 of the injector body 4. Following that, by removing a portion of the injector body 4 that corresponds to the body side sealing surface 45*b* and the internal thread portion 45*a*, the sealing surface 45*b* and the thread portion 45*a* are formed.

Figure 5A:
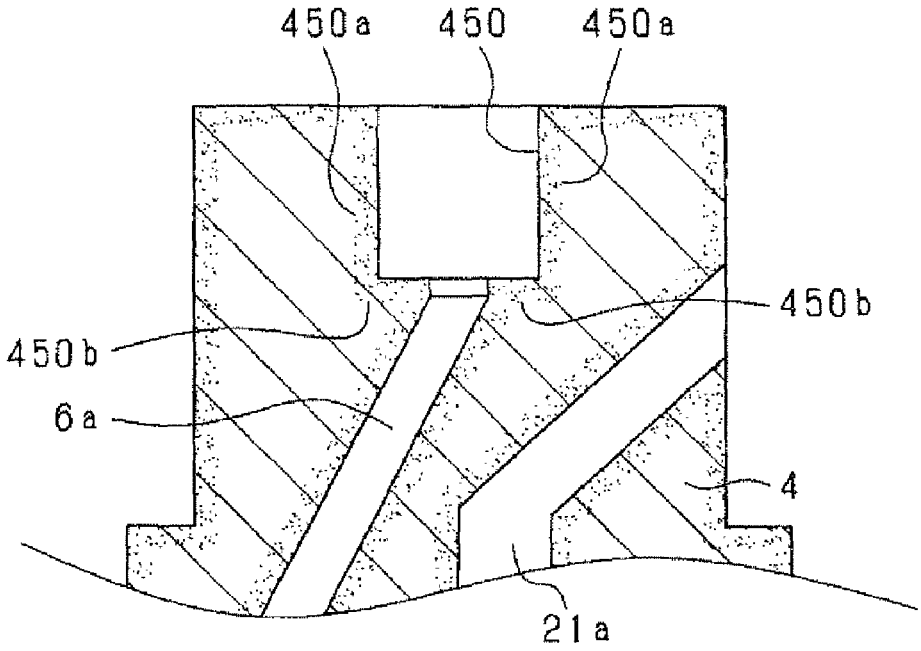
FIG. 5A is a diagram illustrating a manufacturing process of an injector body in accordance with a second embodiment of the invention.
Figure 5B:
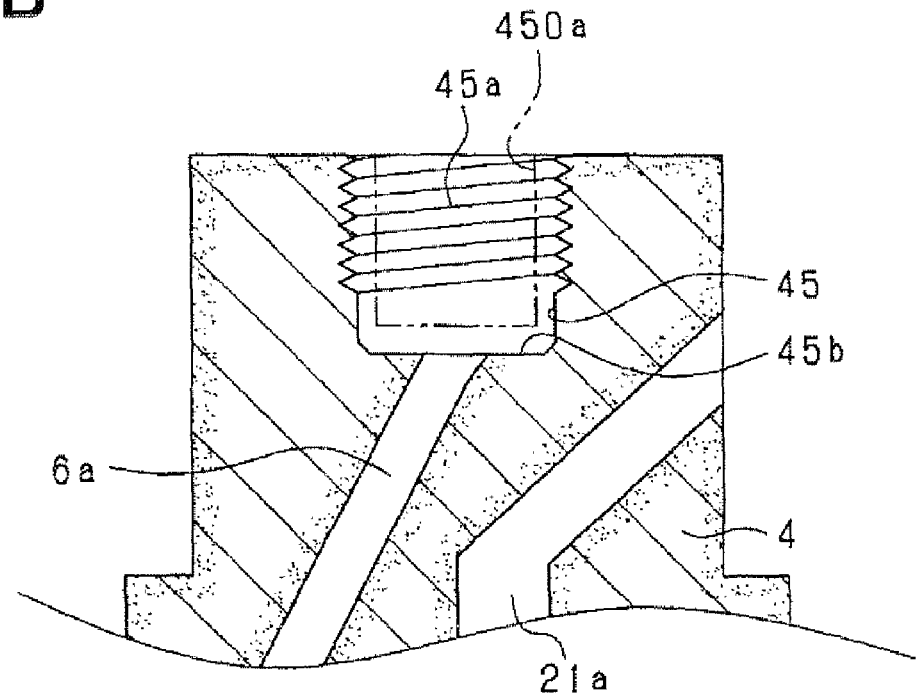
FIG. 5B is a diagram illustrating the manufacturing process of the injector body in accordance with the second embodiment.

The second embodiment will be described in greater detail with reference to FIGS. 5A and 5B. First, by drilling the injector body 4, a high pressure passage 6, a low pressure passage 7, an accommodation hole 41, a branch passage 6*a*, a through hole 21*a*, and the like, are formed. Furthermore, as illustrated in FIG. 5A, a pilot hole 450 having a smaller diameter than the recess 45 is formed by drilling, for example.

Then, without the masking carried out in the first embodiment, the injector body 4 is put into a furnace for heat treatment to perform the carburizing and quenching treatment on the injector body 4 (surface hardening process). A region indicated by halftone dots in FIG. 5A indicates a region (surface hardening layer) that is made to have high hardness after undergoing the carburizing treatment. Subsequently, the portion of the injector body 4 that corresponds to the body side sealing surface 45*b* and the internal thread portion 45*a* (i.e., portion indicated by numerals 450*a*, 450*b*) is removed. More specifically, the recess 45 is cut, such as by drilling, along an inner surface of the pilot hole 450 (removal process).

After that, the internal thread portion 45*a* is formed on an inner peripheral surface of the recess 45 using a cutting tool. Also, by grinding a bottom face of the recess 45, the body side sealing surface 45*b* is formed (sealing surface formation process). An alternate long and two short dashes line 450*a* in FIG. 5B indicates the inner surface of the pilot hole 450. Accordingly, a region of the surface of the injector body 4 that is not removed in the removal process (i.e., region indicated by halftone dots in FIG. 5B) is subjected to the carburizing treatment so as to have high hardness. On the other hand, as for the body side sealing surface 45*b* and the internal thread portion 45*a*, a region of the injector body 4 that is surface-hardened through the carburizing treatment has been removed (i.e., anti-carburized). Hence, the sealing surface 45*b* and the thread portion 45*a* do not have high hardness.

Lastly, by screwing a stem 51, which constitutes a sensor assembly As, to the injector body 4 produced in the above-described manner, a sensor side sealing surface 51*e* is pressed against the body side sealing surface 45*b*, so that they are metal-touch sealed (sensor attachment process).

As a result, in the present embodiment as well, an effect similar to the first embodiment is produced. In the present embodiment, the masking process required in the first embodiment is rendered unnecessary, while the above-described removal process is needed.

Modifications of the above embodiments will be described below. The invention is not limited to the descriptions in the above-described embodiments, and may be embodied through the modifications as follows. Furthermore, characteristic structures in the embodiments may be arbitrarily combined.

Firstly, in the above embodiments, carbon is diffused over the surface of the injector body 4 to be hardened through the carburizing and quenching treatment. Alternatively, carbonitriding quenching treatment that diffuses nitrogen in addition to carbon may be performed.

Secondly, in the above embodiments, the external thread portion 51*d* is formed on the stem 51. Alternatively, the thread portion may be formed, for example, on the plate 53 or the case 56. Moreover, by screwing a retainer (not shown) to the injector body 4 and holding the stem 51 between the retainer and the injector body 4, the stem 51 may be pressed on the body side sealing surface 45*b*.

Thirdly, in the first embodiment, by screwing the stem 51, the attachment of the sensor assembly As to the injector body 4, and the generation of axial force on both the sealing surfaces 51*e*, 45*b* are simultaneously carried out. Alternatively, a thread portion for the attachment of the assembly As to the body 4, and a thread portion for the generation of axial force may be separately provided.

Fourthly, in the above embodiments, the strain gage 52 is employed as the sensor element for detecting the amount of flexure of the stem 51. Alternatively, another sensor element such as a piezoelectric element may be used.

Fifthly, in the sealing surface formation process of the first embodiment, the body side sealing surface 45*b* is formed by grinding the bottom face of the recess 45 of the injector body 4. Alternatively, minimal sealing characteristics may be ensured even without this grinding because the plastic deformation is promoted through the anti-carburization, so that the sealing characteristics are improved. Therefore, in the above embodiments that improve the sealing characteristics by the anti-carburization, working manhours may be reduced by eliminating the grinding.

Sixthly, in the first embodiment, the connections 72*a*, 73*a* of the electrodes 72, 73 connected to the connector terminal 63 are annularly formed. Alternatively, the connections 72*a*, 73*a* may be formed in a shape of a circular arc. As well, the annular connections 72*a*, 73*a* are arranged radially. Alternatively, they may be arranged in the axial direction.

Seventhly, in the above embodiments, the invention is applied to the injector configured such that the high pressure port 43 is formed on the outer peripheral surface of the injector body 4 and that the high pressure fuel is supplied from this outer peripheral surface-side of the body 4. Alternatively, the invention may be applied to the injector configured such that the high pressure port 43 is formed at a portion of the injector body 4 on the opposite side from the nozzle hole 11 in the axial direction of the body 4 and that the high pressure fuel is supplied from the side of this portion of the injector body 4.

Eighthly, and finally, in the above embodiments, the invention is applied to the injector of the diesel engine. Alternatively, the invention may be applied to a gasoline engine, particularly to a direct injection type gasoline engine that injects fuel directly into the combustion chamber E1.

Additional advantages and modifications will readily occur to those skilled in the art. The invention in its broader terms is therefore not limited to the specific details, representative apparatus, and illustrative examples shown and described.

What is claimed is:

1. An injector adapted to be disposed in an internal combustion engine for injecting fuel into the engine, the injector comprising:

a nozzle hole through which fuel is injected;

a metal body that includes a high pressure passage inside the body, wherein high pressure fuel flows into the nozzle hole through the high pressure passage; and a fuel pressure sensor that is attached to the body and configured to detect pressure of high pressure fuel, wherein:

the fuel pressure sensor includes:

a metal flexure element that is resiliently deformed to produce a flexure upon application of the pressure of high pressure fuel to the flexure element; and a sensor element that is configured to convert the flexure produced in the flexure element into an electrical signal and to output the signal as a pressure detection value; and the body further includes:

a sensor high pressure passage that communicates with the flexure element, wherein carburizing treatment is performed on at least a part of the body that defines the sensor high pressure passage; and a body side sealing surface on which the flexure element is pressed and closely-attached so that a clearance between the body and the flexure element is metal-to-metal sealed on the body side sealing surface, wherein the carburizing treatment is not performed on the body side sealing surface of the body.

2. The injector according to claim 1, wherein:

the body further includes a recess in which the flexure element is inserted and disposed;

an interior surface of the recess includes a body side screw portion that is screwed to the flexure element, and the body side sealing surface; and the carburizing treatment is performed on the body except the body side screw portion and the body side sealing surface.

3. The injector according to claim 1, wherein:

the flexure element is formed in a shape of a hollow cylinder having a bottom portion and includes an inflow port through which high pressure fuel flows into the flexure element; and the bottom portion of the flexure element has a thinner wall than a circumferential portion of the flexure element and serves as a diaphragm portion on which the sensor element is attached.

4. The injector according to claim 3, wherein an axial end portion of the flexure element around the inflow port includes a sensor side sealing surface that is closely-attached on the body side sealing surface of the body.

5. The injector according to claim 3, wherein an outer peripheral surface of the circumferential portion of the flexure element includes a sensor side screw portion that is screwed to the body.

6. The injector according to claim 1, wherein:

the body includes a branch passage, which branches from the high pressure passage, as the sensor high pressure passage; and the fuel pressure sensor is disposed to detect the pressure of high pressure fuel in the branch passage.

* * * * *